US011527120B2

(12) United States Patent
Li et al.

(10) Patent No.: US 11,527,120 B2
(45) Date of Patent: Dec. 13, 2022

(54) METHODS AND SYSTEMS FOR OFFLINE VERIFICATION CODE GENERATION BASED ON SMART DOOR LOCK SYSTEM

(71) Applicant: YUNDING NETWORK TECHNOLOGY (BEIJING) CO., LTD., Beijing (CN)

(72) Inventors: Tao Li, Beijing (CN); Haibo Yu, Beijing (CN); Hao Tang, Beijing (CN); Binghui Peng, Beijing (CN); Qi Yi, Beijing (CN); Yun Ye, Beijing (CN)

(73) Assignee: YUNDING NETWORK TECHNOLOGY (BEIJING) CO., LTD., Beijing (CN)

( * ) Notice: Subject to any disclaimer, the term of this patent is extended or adjusted under 35 U.S.C. 154(b) by 0 days.

(21) Appl. No.: 17/474,020

(22) Filed: Sep. 13, 2021

(65) Prior Publication Data

US 2021/0407234 A1 Dec. 30, 2021

Related U.S. Application Data

(63) Continuation-in-part of application No. 16/506,011, filed on Jul. 9, 2019, now Pat. No. 11,120,656, which
(Continued)

(30) Foreign Application Priority Data

Jan. 9, 2017 (CN) ..... 201710014020.8

(51) Int. Cl.
*G07C 9/00* (2020.01)
*G07C 9/33* (2020.01)

(52) U.S. Cl.
CPC ..... *G07C 9/00817* (2013.01); *G07C 9/00309* (2013.01); *G07C 9/00571* (2013.01);
(Continued)

(58) Field of Classification Search
CPC ..... G07C 9/00817; G07C 9/00309; G07C 9/00571; G07C 9/33; G07C 2009/00412; G07C 2209/08
See application file for complete search history.

(56) References Cited

U.S. PATENT DOCUMENTS

2002/0180582 A1* 12/2002 Nielsen ..... G07C 9/21 340/5.6
2013/0094770 A1* 4/2013 Lee ..... G06F 21/36 382/218

(Continued)

FOREIGN PATENT DOCUMENTS

CN 102426715 A 4/2012
CN 103489233 A 1/2014

(Continued)

OTHER PUBLICATIONS

International Search Report in PCT/CN2018/071918 dated Mar. 27, 2018, 7 pages.

(Continued)

*Primary Examiner* — Vernal U Brown
(74) *Attorney, Agent, or Firm* — Metis IP LLC

(57) ABSTRACT

A method and a system for offline verification code generation based on a smart door lock system. The method may include in response to an unlocking event, recording, by a mobile terminal, a trigger time of the unlocking event; in response to the unlocking event, sending, by the mobile terminal, a request for unlocking verification information to a cloud server, wherein the request for the unlocking verification information is used to request the cloud server to return a verification code of a smart door lock, and the unlocking verification information includes a private key seed of the smart door lock and the trigger time; and receiving, by the mobile terminal, the verification code of
(Continued)

the smart door lock for opening the smart door lock generated by the cloud server based on the private key seed and the trigger time.

21 Claims, 8 Drawing Sheets

Related U.S. Application Data is a continuation of application No. PCT/CN2018/071918, filed on Jan. 9, 2018.

(52) U.S. Cl.
CPC ..... *G07C 9/33* (2020.01); *G07C 2009/00412* (2013.01); *G07C 2009/00476* (2013.01); *G07C 2009/00825* (2013.01); *G07C 2209/08* (2013.01)

(56) References Cited

U.S. PATENT DOCUMENTS

| | | | | |
|---|---|---|---|---|
| 2013/0127593 | A1 | 5/2013 | Kuenzi et al. | |
| 2013/0212248 | A1* | 8/2013 | Neafsey | H04W 12/06 709/223 |
| 2013/0249670 | A1* | 9/2013 | Lee | G07C 9/00174 340/5.61 |
| 2014/0375422 | A1* | 12/2014 | Huber | G07C 9/00571 340/5.61 |
| 2016/0035163 | A1 | 2/2016 | Conrad et al. | |
| 2016/0249159 | A1 | 8/2016 | Berg et al. | |
| 2016/0358397 | A1 | 12/2016 | Kristensen et al. | |
| 2019/0371105 | A1 | 12/2019 | Ye | |

FOREIGN PATENT DOCUMENTS

| | | | |
|---|---|---|---|
| CN | 103973437 | A | 8/2014 |
| CN | 104022873 | A | 9/2014 |
| CN | 104200593 | A | 12/2014 |
| CN | 104660719 | A | 5/2015 |
| CN | 104806085 | A | 7/2015 |
| CN | 105279832 | A | 1/2016 |
| CN | 205140033 | U | 4/2016 |
| CN | 105809796 | A | 7/2016 |
| CN | 106067198 | A | 11/2016 |
| CN | 106097487 | A | 11/2016 |
| CN | 106127905 | A | 11/2016 |
| JP | 2013092812 | A | 5/2013 |
| JP | 2016194210 | A | 11/2016 |
| WO | 0231778 | A1 | 4/2002 |
| WO | 2015079203 | A1 | 6/2015 |

OTHER PUBLICATIONS

Written Opinion in PCT/CN2018/071918 dated Mar. 27, 2018, 11 pages.
First Office Action in Chinese Application No. 201710014020.8 dated Sep. 26, 2018, 18 pages.
The Extended European Search Report in European Application No. 18736711.5 dated Dec. 9, 2019, 10 pages.

* cited by examiner

METHODS AND SYSTEMS FOR OFFLINE VERIFICATION CODE GENERATION BASED ON SMART DOOR LOCK SYSTEM

CROSS-REFERENCE TO RELATED APPLICATIONS

This application is a continuation-in-part of U.S. patent application Ser. No. 16/506,011 filed on Jul. 9, 2019, which is a continuation application of International Patent Application Serial No. PCT/CN2018/071918 filed on Jan. 9, 2018, which claims priority to Chinese Patent Application No. 201710014020.8, "a method and system for generating offline verification code based on smart door lock system" filed on Jan. 9, 2017, the contents of each of which are incorporated herein by reference.

TECHNICAL FIELD

The present disclosure relates to a method and system for offline verification code generation based on a smart door lock system which belongs to the intelligent control field, and also belongs to the security technology field and the smart home field.

BACKGROUND

Currently, smart door locks are usually opened using passwords, Bluetooth or NFC, and voices. The password for opening a smart door lock may be usually a temporary password or a permanent password issued remotely. Generally, a gateway may be connected to an Internet, and the smart door lock communicates with the gateway through wireless technology. A user sends a command to add a password to the background of a cloud server through a mobile phone or a webpage. The command is transmitted to the gateway through the Internet and then transmitted to the smart door lock. The smart door lock generates the password successfully. However, due to real-world problems, such as a power outage at the gateway, a network failure at home, or a user who does not have a gateway installed, the password may not be issued remotely.

SUMMARY

The purpose of the present disclosure is to overcome the shortcomings and propose a method for offline verification code generation based on a smart door lock system.

According to a first aspect, the present disclosure provides a method for offline verification code generation based on a smart door lock system, the method including:

in response to an unlocking event, recording, by a mobile terminal, a trigger time of the unlocking event;

in response to the unlocking event, sending, by the mobile terminal, a request for unlocking verification information to a cloud server, wherein the request for the unlocking verification information is used to request the cloud server to return a verification code of a smart door lock, and the unlocking verification information includes a private key seed and the trigger time; and receiving, by the mobile terminal, the verification code of the smart door lock for opening the smart door lock generated by the cloud server based on the private key seed and the trigger time.

In some embodiments, the unlocking event may include at least one of a click confirmation operation, a sliding operation, or a login operation by inputting a password or authentication information.

According to a second aspect, the present disclosure also provides a method for offline verification code generation based on a smart door lock system, the method including:

receiving, by a cloud server, a request for unlocking verification information from a mobile terminal, the unlocking verification information including a private key seed of a smart door lock and a trigger time recorded by the mobile terminal in response to an unlocking event; and generating, by the cloud server, a verification code of the smart door lock after a matching verification of the private key seed is successful and returning the verification code to the mobile terminal for opening the smart door lock.

In some embodiments, the cloud server may be provided with a preset private key seed database configured to store a private key seed of each smart door lock, and before generating the verification code of the smart door lock after the matching verification of the private key seed is successful, the method may further include:

comparing, by the cloud server, the private key seed and the stored private key seed of each smart door lock in the preset private key seed database; and determining that the matching verification of the private key seed is successful if a comparison is successful.

In some embodiments, the generating, by the cloud server, the verification code of the smart door lock and returning the verification code to the mobile terminal for opening the smart door lock may include:

generating, by the cloud server, the verification code using a preset first verification code generation algorithm based on the private key seed and the trigger time within a time period which the trigger time belongs to; and returning the verification code to the mobile terminal for opening the smart door.

In some embodiments, the method may further include:

generating, by the cloud server, a password generation instruction, wherein the password generation instruction is used to make the verification code of the smart door lock take effect in the smart door lock; and returning the password generation instruction to the mobile terminal.

In some embodiments, the generating, by the cloud server, the password generation instruction may include:

generating, by the cloud server, the password generation instruction based on a start code, a command code, a type code, a validity period code, a password, a password ID, a time factor, and a private key seed.

According to a third aspect, the present disclosure also provides a method for offline verification code generation based on a smart door lock system, the method including:

generating, by a smart door lock, a verification code for a current time period using a preset first verification code generation algorithm based on a private key seed of the smart door lock; and in response to receipt of an inputted verification code, comparing the inputted verification code with the verification code for the current time period, the smart door lock being unlocked if the inputted verification code is same as the verification code for the current time period.

In some embodiments, the method may further include:

making the verification code for the current time period take effect in response to receipt of a password generation instruction.

According to a fourth aspect, the present disclosure also provides a mobile terminal, the mobile terminal including:

a recording module configured to in response to an unlocking event, record a trigger time of the unlocking event;

a first sending module configured to in response to the unlocking event, send a request for unlocking verification information to a cloud server, wherein the request for the unlocking verification information is used to request the cloud server to return a verification code of a smart door lock, and the unlocking verification information includes a private key seed of the smart door lock and the trigger time of the unlocking event; and a first receiving module configured to receive the verification code of the smart door lock for opening the smart door lock generated by the cloud server based on the private key seed and the trigger time.

In some embodiments, the unlocking event may include at least one of a click confirmation operation, a sliding operation, or a login operation by inputting a password or authentication information.

According to a fifth aspect, the present disclosure also provides a cloud server, the cloud server including:

a second receiving module configured to receive a request for unlocking verification information from a mobile terminal, the unlocking verification information including a private key seed of a smart door lock and a trigger time recorded by the mobile terminal in response to an unlocking event; and a first generating module configured to generate a verification code of a smart door lock after a matching verification of the private key seed is successful and returning the verification code to the mobile terminal for opening the smart door lock.

In some embodiments, the cloud server may be provided with a preset private key seed database configured to store a private key seed of each smart door lock; and the cloud server may further include:

a verification module configured to compare the private key seed and the stored private key seed of each smart door lock in the preset private key seed database, and determine that the matching verification of the private key seed is successful if a comparison is successful.

In some embodiments, the first generating module may include:

a generating sub-module configured to generate a verification code using a preset first verification code generation algorithm based on the private key seed and the trigger time within a time period which the trigger time belongs to; and a returning sub-module configured to return the verification code to the mobile terminal for opening the smart door.

In some embodiments, the cloud server may further include:

a second generating module configured to generate a password generation instruction, wherein the password generation instruction is used to make the verification code of the smart door lock take effect in the smart door lock; and a returning module configured to return the password generation instruction to the mobile terminal.

In some embodiments, the second generating module may be configured to:

generate the password generation instruction based on a start code, a command code, a type code, a validity period code, a password, a password ID, a time factor, and a private key seed.

According to a sixth aspect, the present disclosure also provides a smart door lock, the smart door lock including:

a third generating module configured to generate a verification code for a current time period using a preset first verification code generation algorithm based on a private key seed of the smart door lock; and a comparing module configured to in response to receipt of an inputted verification code, compare the inputted verification code with the verification code for the current time period, the smart door lock being unlocked if the inputted verification code is same as the verification code for the current time period.

In some embodiments, the smart door lock may further include:

an effective module configured to make the verification code for the current time period take effect in response to receipt of a password generation instruction.

According to a seventh aspect, the present disclosure also provides a smart door lock system, the smart door lock system including a mobile terminal, a cloud server, and a smart door lock, wherein the mobile terminal is configured to record a trigger time of the unlocking event in response to an unlocking event, send a request for unlocking verification information to a cloud server, wherein the request for the unlocking verification information is used to request the cloud server to return a verification code of a smart door lock, and the unlocking verification information includes a private key seed of the smart door lock and the trigger time;

the cloud server is configured to generate the verification code of the smart door lock after a matching verification of the private key seed is successful and return the verification code to the mobile terminal for opening the smart door lock; and the smart door lock is configured to generate a verification code for a current time period using a preset first verification code generation algorithm based on a private key seed of the smart door lock; in response to receipt of an inputted verification code, compare the inputted verification code with the verification code for the current time period, the smart door lock being locked if the inputted verification code is the same as the verification code for the current time period.

The methods for generating the offline verification code based on a smart door lock system provided by the present disclosure provide may obtain a valid temporary password remotely, or obtain a password generation instruction when the smart door lock does not have a communication function. For example, the password may be enabled by entering the password generation instruction via a door lock panel. The method may solve the problems that the password cannot be issued remotely when gateway power outage, wireless failure or without the installation of the gateway. In the meantime, the methods may not need to install a communication module inside the smart door lock for interacting with a gateway and a cloud server, which may greatly reduce energy consumption.

The description is only an overview of the present disclosure technical solution. In order to be able to understand the technical means of the present disclosure more clearly, it may be implemented in accordance with the contents of the specification, and in order to make the above and other purposes, features and advantages of the present disclosure more understandable, the following is a specific implementation of the present disclosure.

BRIEF DESCRIPTION OF THE DRAWINGS

Various other advantages and benefits will become apparent to the skilled in the art by reading the following detailed descriptions of the preferred embodiments. The drawings are only for the purpose of illustrating the preferred embodiments and are not considered as a limitation of the present disclosure. Also, like reference numerals represent similar structures throughout the several views of the drawings. In the drawings.

DETAILED DESCRIPTION

Figure 1:
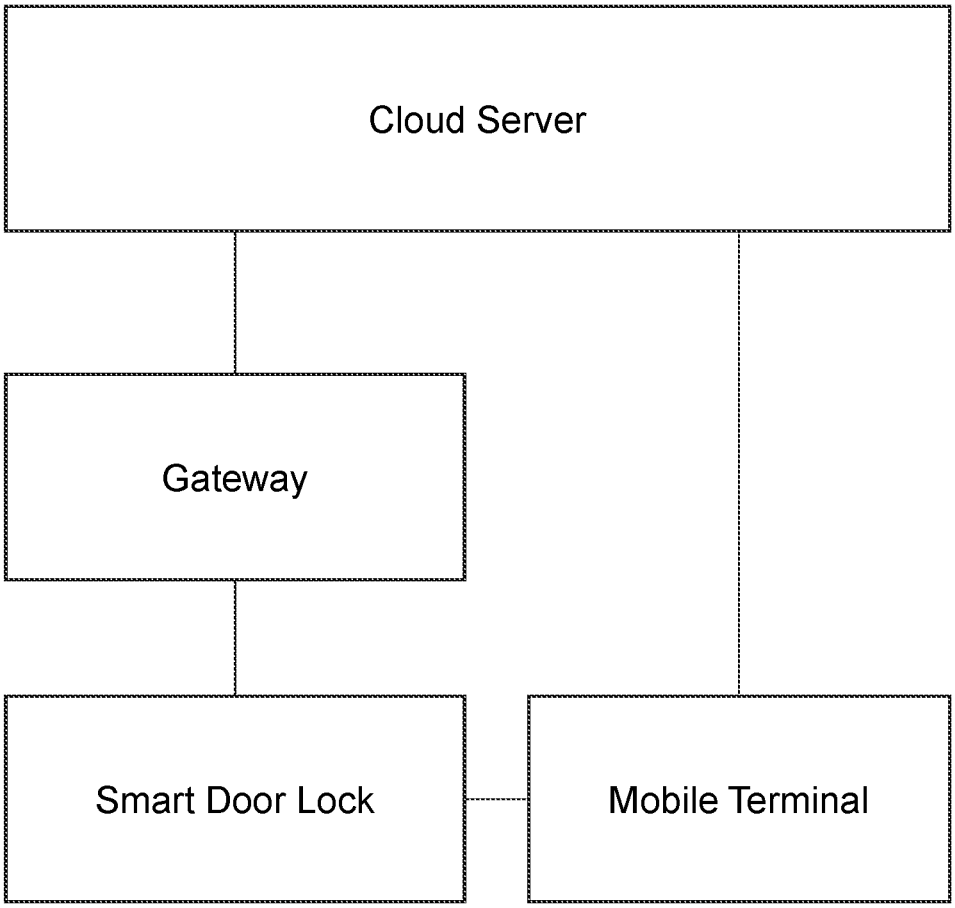
FIG. 1 is a block diagram of a smart door lock system based on dynamic password in the prior art.

The exemplary embodiments of the present disclosure will be described in more detail below with reference to the accompanying drawings. While exemplary embodiments of the present disclosure are shown in the drawings, it should be understood that the present disclosure may be embodied in various forms and not limited by the embodiments set forth herein. On the contrary, these embodiments are provided so that this present disclosure will be more fully understood, and the scope of the present disclosure may be fully disclosed to those skilled in the art.

FIG. 1 shows a smart door lock system based on a dynamic password in the prior art. The implementation process of which needs to rely on one or more wireless communication modules in a smart door lock to realize the request and sending of a password through a gateway and a cloud server, which may cause technical problems or defects including: first, the increase of energy consumption of the smart door lock as the wireless communication modules needs a long time and a large amount of power supply; second, the unavailability of the password remotely issued for the interactive terminal as power failure, the gateway outage, or the home network failure.

According to the problems described above, the present disclosure provides a method for offline verification code generation based on a smart door lock system. The method may obtain a valid temporary password remotely, or obtain a password generation instruction when the smart door lock does not have a communication function. For example, the password may be enabled by entering the password generation instruction via a door lock panel. The method may solve the problems that the password cannot be issued remotely when gateway power outage, wireless failure or without the installation of the gateway. In the meantime, the methods may not need to install a communication module inside the smart door lock for interacting with a gateway and a cloud server, which may greatly reduce energy consumption.

Figure 2:
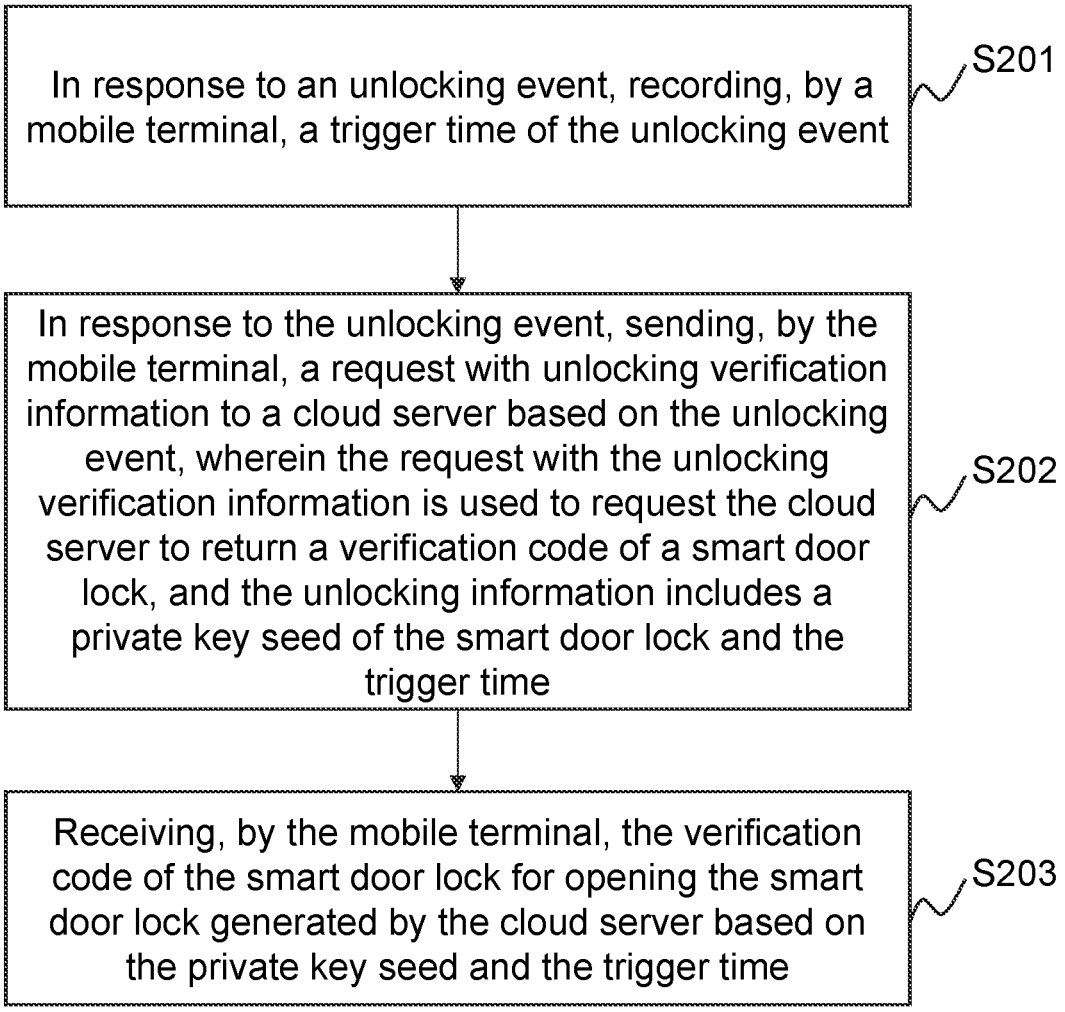
FIG. 2 is a flowchart illustrating a process for offline verification code generation based on a smart door lock system according to some embodiments of the present disclosure.

FIG. 2 illustrates a process for offline verification code generation based on a smart door lock system implemented on a mobile terminal according to some embodiments of the present disclosure. The process may include:

S201: in response to an unlocking event, recording, by the mobile terminal, a trigger time of the unlocking event.

The unlocking event may include an operation of a user, for example, a click operation for confirmation, a sliding operation, a login operation by inputting a password or authentication information, etc. When the mobile terminal detects the unlocking event, the mobile terminal may record the trigger time of the unlocking event in a background of the mobile terminal. The trigger time may be used to obtain a verification code of a smart door lock.

The mobile terminal may include a smart mobile device, such as a mobile phone, an IPAD, a laptop computer, a smartwatch, a smart bracelet, etc. For example, when the user clicks an unlocking confirmation button or slides an unlocking switch on a display on a smartphone, an IPAD, a mobile laptop computer, etc., or enters a password or authentication information through an application implemented on the mobile terminal or a webpage to log on, the unlocking event may be triggered. The unlocking event may also be triggered by a smartwatch, a smart bracelet, etc., and the trigger time may be recorded in the background of the mobile terminal.

S202: sending, by the mobile terminal, a request for unlocking verification information to a cloud server in response to the unlocking event. The request for the unlocking verification information may be used to request the cloud server to return the verification code of the smart door lock. The unlocking verification information may include a private key seed of the smart door lock and/or the trigger time. As used herein, the trigger time may include time information corresponding to the unlocking event. The trigger time may include one or more time points and/or a time period. In some embodiments, the trigger time may refer to a current time recorded by the mobile terminal when the unlocking event happens. In some embodiments, the trigger time may refer to a current time recorded by the mobile terminal when the unlocking event is confirmed. For example, the unlocking event may include touching a screen of the mobile terminal and dragging or gliding from a first position to a second position following a particular path. The trigger time may be the time point the second position is touched. As another example, the unlocking event may include clicking one or more times on a device (e.g., clicking on one or more virtual keys of the mobile terminal device). The trigger time may be one or more times points corresponding to the one or more times of clicking on the device. As a further example, the unlocking event may include a user request corresponding to generation of an offline password. The trigger time may be a time point of receiving or generating the request. In some embodiments, the trigger time may refer to a time period. For example, the trigger time may be a time period including a start time and an ending time of the unlocking event. In some embodiments, all unlocking events happened between a preset time period (e.g., a plurality of users request to unlock a smart door lock in a preset time period, a doorkeeper frequently requests to open a smart door lock in a preset time period) may be assigned with the same trigger time. For example, all unlocking events happened between 1:00 to 1:59 (e.g., 1:01, 1:08, 1:20, 1:50) may be assigned with 1:00. The trigger time may be recorded by the mobile terminal according to a timing mechanism of the mobile terminal. In some embodiments, the trigger time may be recorded by the server according to a timing mechanism of the server. For example, the trigger time may be recorded by the server based on a time point when the server received a request corresponding to an unlocking event. In some embodiments, the trigger time may be recorded by a device sending a request for unlocking a smart door lock. For example, a first terminal (e.g., a notebook computer controlled by a hotel manager) may request to unlock a smart door lock and to return a verification code to second terminal (e.g., a mobile terminal of a client of the hotel). The trigger time may be recorded by the first terminal. The second terminal may be a preset terminal (e.g., a paired terminal of a smart door lock) or determined based on information included in the request.

In some embodiments, the cloud server may be provided with a preset private key seed database. The preset private key seed database may be configured to store multiple private key seeds of multiple smart door locks. A private key seed of each smart door lock may include a secret key which is unique and non-repetitive. As used herein, a private key seed of a smart door lock stored in the preset private key seed database may be also referred to as a reference private key seed. Each smart door lock may include one single private key seed. A corresponding relationship between the reference preset private key seed and each smart door lock may be stored in the preset private key seed database. A mobile terminal may also store a private key seed after the mobile terminal is bounded to a smart door lock with the private key seed. In other words, the mobile terminal may include a corresponding relationship with the private key seed of the smart door lock. The mobile terminal may obtain the private key seed of the smart door lock based on the corresponding relationship between the private key seed of the smart door lock and the mobile terminal. In some embodiments, the mobile terminal may include a corresponding relationship with the private key seed of the smart door lock and the smart door lock. The mobile terminal may obtain the private key seed of the smart door lock based on the corresponding relationship between the private key seed of the smart door lock, the mobile terminal, and the smart door lock. In some embodiments, the corresponding relationship between the private key seed of the smart door lock, the mobile terminal, and/or the smart door lock may be stored in the preset private key seed database or any other storage.

The mobile terminal may send the request for the unlocking verification information to the cloud server in response to detect the unlocking event for request the cloud server to return the verification code of the smart door lock. The unlocking verification information may include the private key seed of the smart door lock and/or the trigger time of the unlocking event. The private key seed may include one single corresponding relationship with the smart door lock. The private key seed of a smart door lock may be generated, written to the smart door lock, and stored in the cloud server simultaneously when the smart door lock leaves a factory. As used herein, the private key seed of a smart door lock written to and stored in the smart door lock (e.g., a storage device installed in the smart door lock) may be also referred to as a local private key seed. The local private key seed may be used by the smart door lock for generating a verification code which may be referred to as a reference verification code. The private key seed of each smart door lock may be different to ensure the security of a dynamic password of each smart door lock. Even if an encryption algorithm is leaked and a hacker gets the private key of a specific smart door lock, it will not threaten smart door locks of other users.

S203: receiving a verification code of the smart door lock for opening the smart door lock generated by the cloud server based on the private key seed and the trigger time.

The cloud server may generate the verification code of the smart door lock after receiving the private key seed and the trigger time from the mobile terminal. The cloud server may return the verification code to the mobile terminal. A user may use the verification code displayed on the mobile terminal. For example, the user may input the verification code into the smart door lock via a user interface implemented on the smart door lock and displayed by a panel of the smart door lock. As another example, the user may input the verification code into the smart door lock via a panel connected with the smart door via a wireless connection (e.g., Bluetooth). The smart door lock (e.g., a processor installed in the smart door lock) may generate a reference verification code based on the local private key seed of the smart door lock. The smart door lock (e.g., a processor installed in the smart door lock) may compare the reference verification code with the inputted verification code. The smart door lock may be unlocked in response to a determination that the reference verification code and the inputted verification code are matched.

According to the process for generating the off-line verification code based on a smart door lock system provided by the present disclosure, the mobile terminal may record the trigger time of the unlocking event in response to the unlocking event, and send the request for the private key seed of the smart door lock and the trigger time to the cloud server, so as to request the cloud server to return the verification code of the smart door lock. After the mobile terminal receives the verification code, the verification code may be used to open the smart door lock. In the case of the smart door lock being offline, the smart door lock according to some embodiments of the present disclosure may obtain the verification code from the cloud server and finish the opening of the smart door lock, which may solve the problem that the password cannot be issued to open the smart door lock during a gateway power outage, a wireless connection failure, or without the installation of the gateway. In some embodiments, a smart door lock does not need to have a communication module for interacting with a gateway and a cloud server, which may greatly reduce its own energy consumption.

In addition, the smart door lock system of some embodiments of the present disclosure may only need to install a preset verification code generation algorithm in each time period, generate a verification code (e.g., a reference verification code), and store the verification code (e.g., a reference verification code) inside a lock. A communication module for interacting with a gateway and a cloud server may not need to be installed inside the lock, which greatly reduces its energy consumption and reduces its size. Therefore, the smart door lock system can be not restricted by the external network environment and may be opened based on an offline verification code. The smart door lock system without the communication module may be safe, reliable and independent of the external network environment.

Figure 3:
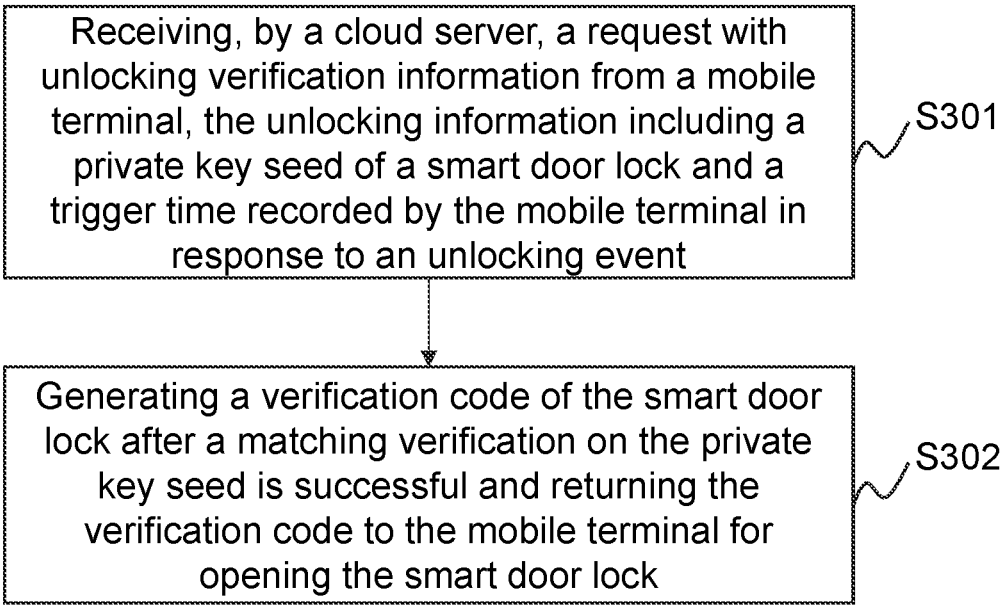
FIG. 3 is a flowchart illustrating another process for offline verification code generation based on a smart door lock system according to some embodiments of the present disclosure.

Corresponding to the above embodiment, the present disclosure provides a process for offline verification code generation based on a smart door lock system implemented on a cloud server with reference to FIG. 3. FIG. 3 illustrates another process for offline verification code generation based on a smart door lock system according to some embodiments of the present disclosure. The process may include:

S301: receiving, by a cloud server, a request for unlocking verification information from a mobile terminal. The unlocking verification information may include a private key seed and/or a trigger time recorded by the mobile terminal in response to an unlocking event.

S301 in the embodiment of the present disclosure may be understood with reference to S201 and S202 in the above-mentioned embodiment, and are not repeated here.

S302: generating, by the cloud server, a verification code of a smart door lock and returning the verification code of the smart door lock to the mobile terminal for opening the smart door lock after a matching verification of the private key seed is successful.

In some embodiments, after the cloud server receives the request for the unlocking verification information, the cloud server may obtain the private key seed included in the request. The private key seed included in the request may be obtained by the mobile terminal based on a corresponding relationship between the private key seed, the mobile terminal and/or the smart door lock as described in elsewhere in the present disclosure (e.g., FIG. 2 and the descriptions thereof). In some embodiments, the cloud server may compare the obtained private key seed with the stored private key seed (i.e., reference private key seeds) of each smart door lock in the preset private key seed database. If the comparison is successful, i.e., the preset private key seed database stores the obtained private key seed, the matching verification of the obtained private key seed may be successful; otherwise, the matching verification of the obtained private key seed may be unsuccessful. In some embodiments, the cloud server may generate the verification code of the smart door lock and return the verification code of the smart door lock to the mobile terminal for opening the smart door lock after a matching verification of the smart door lock is successful. For example, the mobile terminal may include a corresponding relationship between the smart door lock and the corresponding relationship between the smart door lock and the mobile terminal may be stored in the mobile terminal or any other storage. The mobile terminal may obtain an identity (e.g., an ID number) of the smart door lock based on the corresponding relationship between the smart door lock and the mobile terminal and send the request including the identity (e.g., an ID number) of the smart door lock to the cloud server. The preset private key seed database may store a corresponding relationship between each smart door lock and the reference private key seeds and/or an identity (e.g., an ID number) of the each smart door lock. The cloud server may compare the obtained identity (e.g., an ID number) of the smart door lock from the mobile terminal with the stored identity (e.g., an ID number) of the smart door lock of each smart door lock in the preset private key seed database. If the comparison is successful, i.e., the preset private key seed database stores the obtained identity (e.g., an ID number) of the smart door lock, the matching verification of the obtained private key seed may be successful; otherwise, the matching verification of the obtained private key seed may be unsuccessful.

The cloud server may generate the verification code of the smart door lock and return to the mobile terminal for opening the smart door lock if the matching verification of the obtained private key seed is successful.

In some embodiments, the cloud server may generate a plurality of verification codes of the smart door lock within an upper threshold in a time period (e.g., from 8:00 a.m. to 10:00 a.m., from 11:00 a.m. to 12:00 p.m., from 3:15 p.m. to 10:00 p.m.). The upper threshold is a maximum number (or count) of verification codes the cloud server can generate for the time period. That is to say, if the number (or count) of the plurality of verification codes that have been generated in the time period has reached the upper threshold, no further verification code can be generated by the cloud server for that time period. In some embodiments, the cloud server may generate the plurality of verification codes in a single operation. The plurality of verification codes may be stored in a storage device and be sent to the mobile terminal in response to a request. In some embodiments, the cloud server may generate a portion of the plurality of verification codes in response to a triggering condition (e.g., a user request, a start of a time period). For the situation of generating the plurality verification codes in response to the triggering condition, a counter may be employed to record the number (or count) of the verification codes generated (or left to be generated) for a particular time period.

In some embodiments, the upper threshold may be a fixed number (e.g., 5, 10, 15, 20, 30, 50, or the like) fora fixed time period (e.g., 10 minutes, 1 hour, 3 hours, 1 day). In some embodiments, the upper threshold and the corresponding time period may be determined by a process. The process may include acquiring a plurality of data and determining a mapping relationship between an upper threshold and a corresponding time period for different scenarios of using a smart door lock. The plurality of data may include usage records of the smart door lock, information (e.g., visitor traffic) corresponding the scenarios of using the smart door lock, or the like, or a combination thereof.

For example, by clustering time information of unlocking events recoded in historical unlocking records, one or more time periods may be determined. Associating with the determined one or more time periods, their corresponding actual number (or count) of unlocking events may also be determined, and the upper threshold may be set based on (e.g., equal to, below, or higher than) the actual number of unlocking events.

As another example, a relatively high upper threshold for a time period (e.g., 12 per hour) may be employed in a relatively high frequency scenario of using the smart door lock (e.g., a laboratory or an office shared by a plurality of people); and a relatively low threshold for the same time period may be employed in a relative lower frequency scenario of using the smart door lock (e.g., an individual laboratory or an CEO office).

As a further example, from 6:00 a.m. to 7:00 a.m. on a workday, which is a morning rush hour of unlocking of a smart door lock, a relatively high (e.g., 100) upper threshold may be used. From 1:00 a.m. to 2:00 a.m., which is an off-peak hour and with a relatively low possibility of unlocking of the smart door lock, a relatively low (e.g., 10) upper threshold may be used.

In some embodiments, a multi-set mechanism may be employed by the smart door lock and the cloud server to generate the verification code (e.g., a one-time verification code). Merely by way of example, under the multi-set mechanism, three sets of verification codes may be employed. The three sets may include a set M including verification codes valid in a first time period (e.g., from 2:00 p.m. to 2:59 p.m.), a set L including verification codes valid in a second time period (e.g., from 1:00 p.m. to 1:59 p.m.) that immediately precedes the first time period, and a set R including verification codes valid in a third time period (e.g., from 3:00 p.m. to 3:59 p.m.) that immediately follows the first time period. The first time period, the second time period, and the third time period may include the same time duration (e.g., 1 hour, 8 hours) or different time durations (e.g., the first time period is 2 hours, the second time period and the third time period are both 1 hour).

In some embodiments, one or more verification codes may be included in the three sets. For example, a time period corresponding to each of the three sets of verification codes may be 1 hour and 4 verification codes may be included in each of the three sets. Associated with each of the one or more verification codes, the three sets may also include a verification code ID, a marker for indicating the validity of a verification code, or the like, or a combination thereof.

Under the multi-set mechanism, one or more of the three sets of verification codes may be updated every hour on the hour, or when power is provided to the device (e.g., the smart door lock or the cloud server) where the three sets are stored. In some embodiments, the three sets of verification codes may also be updated at a time point determined based on a user request. The updating of the verification code set may include generating one or more verification codes based on a verification code generation algorithm as illustrated elsewhere in the present disclosure. See, e.g., the description in FIG. 5 or FIG. 6. In some embodiments, the updating of the verification code set may include data migration between the three sets. In a data migration process, a verification code valid in one time period may be designated as a verification code of another time period. For example, the verification codes included in the set M may be migrated to the set L. As another example, the verification codes included in the set R may be migrated to the set M.

In some embodiments, verification codes of the smart door lock included in the cloud server, which are subsequently used by a user, may be generated by the cloud server and corresponding reference verification codes of the smart door lock are generated by the smart door lock. The verification code operation as described in some embodiments of the present disclosure may be performed based on time information (e.g., a time period in which a verification code is valid), while it may take time for the cloud server to synchronize with the smart door lock. The multi-set mechanism may provide a margin when time synchronization between the cloud server and the smart door lock fails. The range of the margin may be determined based on the duration of the second time period and the third time period. For example, when a verification operation on a verification code (e.g., a verification operation as illustrated in 845 of FIG. 8) is performed, the set M may be used firstly in the verification operation; in response to determining that the verification code does not match any veridiction code included in the set M, the set L and/or the set R may be used in the verification operation. A verification failure of the verification code may be determined only when all of the three sets fail to perform the verification operation on the verification code. As another example, when a verification operation on a verification code (e.g., a verification operation as illustrated in 845 of FIG. 8) is performed, the set M may be used firstly in the verification operation; in response to determining that the verification code does not match any veridiction code included in the set M and that the time point when the verification code (or a request to unlock the smart door lock) is received is close to the start time (or the ending time) of the time period of the set M, the verification codes in the set L (or the set R) may be used in the verification operation. As used herein, a first time point being close to a second time point (e.g., the start time, the ending time, etc., of a time period) indicates that the time interval between the first time point and the second time point is below a threshold, e.g., 1 minute, 2 minutes, 30 seconds, etc.

In some embodiments, a time difference threshold may be employed to limited the range. If a verification code can not match any reference verification code included in the M set, the verification code may further be processed based on the verification codes of the L set and the R set if a time difference between a time recorded by the smart door lock and a time recorded by the cloud server is no more than the time difference threshold. For example, the time difference threshold may be 10 minutes, a verification code may be verified based on the verification codes of another time period regardless of whether the time recorded in the smart door lock is faster or lower than the cloud server by no more than 10 minutes.

In some embodiments of the present disclosure, the verification code of the smart door lock may be generated according to two ways. Details may be provided below.

In one of the two ways, the verification code of the smart door lock may be a dynamic password. Specifically, the cloud server may generate a dynamic password in a preset time period based on the private key seed with the successful matching verification and the trigger time. As used herein, the preset time period may be associated with the trigger time. The trigger time may be also referred to as a current time recorded by the mobile terminal. The preset time period may be also referred to as a current time period. For example, the trigger time may be within the preset time period. As a further example, if the trigger time is 9:45 a.m., the preset time period associated with the trigger time may be 8:00 a.m. to 10:00 a.m., or may be 9:00 a.m. to 10:00 a.m., or may be 9:30 a.m. to 10:00 a.m., etc.

The cloud server may generate the dynamic password using a preset first verification code generation algorithm. The first verification code generation algorithm may include but not is limited to various Hash algorithms. The private key seed and the trigger time received by the cloud server may be as input parameters of the first verification code generation algorithm to generate the verification code of the smart door lock at a current time. The verification code may be a dynamic password. In other words, the verification code of the smart door lock may be different for different time periods. In some embodiments, different trigger times may correspond to different verification codes of the smart door lock generated by the cloud server. For example, different trigger times belonging to different time periods may correspond to different verification codes. In some embodiments, different trigger times may correspond to a same verification code of the smart door lock. For example, different trigger times belonging to a same time period may correspond to a same verification code.

Specifically, the cloud server may determine a time period which the dynamic password the generated verification code of the smart door lock belongs to according to the trigger time. The cloud server may determine the verification code of the smart door lock based on the time period the trigger time belongs to. For example, the cloud server may determine the verification code of the smart door lock based on the beginning time or integral time of the time period the trigger time belongs to. In some embodiments, the cloud server may convert the trigger time and the private key seed into a digital password, for example, a six-digit password using the preset first verification code generation algorithm.

Correspondingly, the smart door lock may generate verification codes at different time periods using the same preset verification code generation algorithm (e.g., the preset first verification code generation algorithm) as the cloud server generating the verification code. As used herein, a verification code generated by the smart door lock may be also referred to as a reference verification code. The smart door lock (e.g., a processor installed in the smart door lock) may generate a reference verification code for a time period based on the local private key seed stored in the smart door lock (e.g., a storage device installed in the smart door lock).

Specifically, the smart door lock may calculate and store a dynamic password (i.e., reference verification code) of a current time period at the beginning of each time period applying the first verification code generation algorithm. The dynamic password for the current time period may be a verification code of the smart door lock outputted based on a combination of the beginning of each time period and the private key seed. The beginning of a time period as an input parameter of the first verification code generation algorithm may include a beginning time of every hour or half hour in the time period. The cloud server and the smart door lock may use a same verification code generation algorithm to generate verification codes corresponding to each time period. After receiving an input of a verification code by a user via a user interface implemented on the smart door lock, the smart door lock may compare the verification code with a stored verification code (i.e., reference verification code) of the current time period. If the verification code is the same as the stored verification code, the smart door lock may be unlocked; otherwise, the smart door lock may not be opened. In some embodiments, the smart door lock may generate and store the dynamic password (i.e., reference verification code) for each time period based on the local private key seed using a first verification code generation algorithm. The cloud server may generate the dynamic password (i.e., verification code) for the current time period based on the private key seed included in the unlocking verification information, i.e., the reference private key seed, using a second verification code generation algorithm. The first verification code generation algorithm and the second verification code generation algorithm may be the same or different.

In order to eliminate a deviation of the local time of the smart door lock from the time of the cloud server, the time may accurate to an hour level, that is, the time period may be every hour.

In order to increase the time span of a dynamic password, for example, a password generated at 2:59 may be expired after 1 minute and the availability of this dynamic password may be greatly reduced, a buffering mechanism may be added in some embodiments. The buffering mechanism may include an immediately previous dynamic password for the immediately previous hour (or prior time period) which may be reserved when the smart door lock generates the dynamic password for a current hour (or current time period). That is, the dynamic passwords of both the current hour (or current time period) and the immediately previous hour (or prior time period) are valid at any time, which may ensure that the minimum validity period of a dynamic password may be one hour (or one time period) and the maximum validity period of the dynamic password may be two hours (or two consecutive time periods), so as to avoid the dynamic password failure. In some embodiments, the cloud server may generate the verification code corresponding to the trigger time (e.g., 9:59 a.m.) that belongs to a current time period (e.g., 10:00 a.m. to 11:00 a.m.) defined by the cloud server. The smart door lock may generate a first reference verification code by the smart door lock for a current time period (e.g., 10:00 a.m. to 11:00 a.m.) defined by the smart door lock which is different from the current time period (e.g., 10:00 a.m. to 11:00 a.m.) defined by the cloud server because of a deviation of the local time of the smart door lock from the time of the cloud server. The smart door lock may obtain a second reference verification code generated and stored by the smart door lock for a prior time period (e.g., 9:00 a.m. to 10:00 a.m.). The smart door lock may compare the verification code with the first reference verification code and the second reference verification code. If the verification code is the same as one of the first reference verification code and the second reference verification code, the smart door lock may be unlocked; otherwise, the smart door lock may not be opened.

In another one of the two ways, the verification code generated by the cloud server may include a password generation instruction. The cloud server may generate the password generation instruction for making a verification code (i.e., reference verification code) of the smart door lock to be effective in the smart door lock. A user may open the smart door lock using the verification code (i.e., reference verification code). As used herein, the password generation instruction generated by the cloud server may be also referred to as the verification code generated by the cloud server.

In some embodiments, the verification code (i.e., reference verification code) of the smart door lock may further be configured to cause the smart door lock to do one or more operations including, such as, deleting data, disabling data, enabling data, or the like, or a combination thereof. The data may include a password, a usage record of a verification code, a usage record of the smart door lock, or the like, or any combination thereof. More details regarding the data may be found elsewhere in the present disclosure. See, e.g., the description in connection with one or more verification codes and corresponding information of the one or more verification codes in FIG. 8.

In some embodiments, the deleting data may include a physical deletion of the data and/or a logical deletion of the data. As used herein, a physical deletion of the data indicates that the data is permanently deleted from a storage device in the smart door lock (e.g., the storage module 603 of the smart door lock). As used herein, a logical deletion of the data indicates preventing the data from being retrieved from a storage device in the smart door lock (e.g., the storage module 603 of the smart door lock). For example, one or more passwords which have been used to unlock the smart door lock may be recorded and stored as historical records. The verification code may be configured to delete all or a portion of the historical records (e.g., historical records of a specific password, historical records in last 7 days). As another example, one or more selected passwords may be deleted, regardless of whether they have been used or not within a time period. The passwords to be deleted may be designated by a user of the smart door lock through, e.g., a keypad.

In some embodiments, the disabling data may include deactivating a password so that the smart door lock cannot be unlocked using the password, discontinuing or suspending the pairing of a mobile terminal with one or more characters so that the smart door lock cannot be unlocked from the mobile terminal, disabling the smart door lock in a situation (e.g., in a time period) such that the smart door lock cannot be unlocked using any password (e.g., in the time period), or the like, or a combination thereof. The one or more characters of the mobile terminal may include a user ID associated with the mobile terminal, a communication type of the mobile terminal (e.g., a, 4G mobile terminal, a 5G mobile terminal), a brand of the mobile terminal, an operating system of the mobile terminal, or the like, or any combination thereof. For example, if an operating system of Android is marked as data that is disabled (or referred to as disable data for brevity), a verification code of a smart door lock returned by a cloud server in response to a request from an Android phone (or an Android tablet) may not unlock the smart door lock even if the verification code including a password is valid.

The password generation instruction generated by the cloud server may include one or more digits and #*. An input of the password generation instruction may include a start code, a command code, a type code, a validity period code, a password, a password ID, a check code, a time factor, a private key seed, or the like, or a combination thereof.

The check code may be used to verify the legitimacy and integrity of the instruction. The check code may include a different number of digits based on the need for security. The longer the number of digits, the safer it is. At the same time, the generated password generation instruction will be lengthened, which may increase the difficulty of the input for a user. For different usage scenarios, the different number of digits of the check code may be used for different user groups.

A private key seed may be similar to the private key seed of the dynamic password, which may be generated when the door lock is shipped from the factory, written to the smart door lock, and stored in the cloud server simultaneously. The private key of each door lock may be different to ensure that the password generation instruction for each smart door lock is generated safely. In some embodiments, the private key seed may be the private key seed included in the unlocking verification information which is obtained by the mobile terminal in response to detect the unlocking event. The time factor may be associated with the trigger time of the unlocking event.

The password ID may be used for the subsequent management of passwords. In the cloud server, the password ID may correspond to a specific name determined by the user, so that when managing the password list of a door lock, the operation object may be the password ID. The password ID may be optional when generating the password generation instruction.

The command code may be used to add, delete, change, check, etc., the password. Of course, instruction codes (e.g., the type code, the validity period code, or the like, or a combination thereof) behind the command code in the instruction may be different according to different command codes. Other input parameters may be not described in detail here.

The input parameters of an algorithm for generating the password generation instruction may include the input parameters as described above, the private key seed, and the trigger time. For example, the password generation instruction may be denoted by a private algorithm ((the start code+ the command code+ the type code+ the validity period code+ the password+ the password ID), the private key seed, the trigger time).

The validity period code may be used to adjust, determine, and/or control a validity period of the password generation instruction. For example, the validity period of the password generation instruction may be one hour, half of the day, one day, etc. The trigger time may accurate to the day level, and may be 0 o'clock of the same day. Therefore, the validity period of the password generation instruction may be valid for the day of the input. According to the requirements, it is possible to extend the validity period of the password generation instruction by means of time-forward compatibility. For example, if the check code is verified by a 0 o'clock of the current day and 0 o'clock of the yesterday simultaneously, the maximum validity period of the password generation instruction may be extended to be two days.

In some embodiments, the password generation instruction may be generated by combining the dynamic password. The password segment may be removed from the password generation instruction, and a two-digit number may be used to specify which hour of the dynamic password may be used. According to the convention, the two-digit number may be used to specify 100 hours, that is, one of the dynamic passwords during the time period from the beginning of a specific hour to the next 100 hours may be specified as a valid password of the password generation instruction. This method may reduce the password segment in the password generation instruction to two digits, which may reduce the number of digits of the entire password generation instruction.

In order to avoid duplication with the dynamic password, the dynamic password generation mechanism may be reserved by adding a variable factor ensuring the dynamic password not duplicated with dynamic password described above.

The cloud server may return the password generation instruction to the mobile terminal after generating the password generation instruction. The user may make a password of the smart door lock take effect using the password generation instruction displayed on the mobile terminal. That is to say, the password of the smart door lock may be activated based on the password generation instruction. For example, the user may make the dynamic password generated using the first verification code generation algorithm take effect on the smart door lock. Especially, the smart door lock may analysis the password generation instruction to generate a valid verification code. After the user input a correct verification code, the smart door lock may be opened. In some embodiments, the dynamic password (i.e., reference verification code) taking effect as the password generation instruction may be generated by the smart door lock based on the local private key seed of the smart door lock using the first verification code generation algorithm. In some embodiments, the smart door lock may analysis the password generation instruction inputted by the user via a user interface implemented on the smart door lock via a panel connected with the smart door lock via a wireless connection (e.g., Bluetooth). The smart door lock may generate a verification code based on the private key seed obtained from the password generation instruction and/or the trigger time using the first verification code generation algorithm. The verification code may be inputted by the user via the user interface implemented on the smart door lock. If the inputted verification code is correct, the smart door lock may be unlocked. In some embodiments, the smart door lock may compare the generated verification code based on the private key seed obtained from the password generation instruction and/or the trigger time using the first verification code generation algorithm with one or more reference verification codes stored in the smart door lock. If the generated verification code matches one of the one or more reference verification codes, the inputted verification code is correct. In some embodiments, the smart door lock may analysis the password generation instruction inputted by the user. If the password generation instruction is correct, the smart door lock may make a reference verification code for a time period when the trigger time belongs to take effect. In some embodiments, the smart door lock may be unlocked when the reference verification code for the time period when the trigger time belongs to takes effect. In some embodiments, the smart door lock may determine that the password generation instruction is correct in response to determine the private key seed included in the password generation instruction is matched with the local private key seed.

Figure 4:
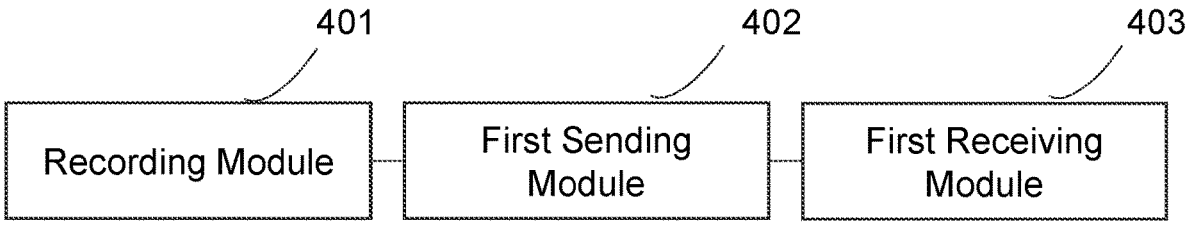
FIG. 4 is a block diagram of a mobile terminal according to some embodiments of the present disclosure.

Corresponding to the above embodiments, the present disclosure also provides a mobile terminal with reference to FIG. 4. FIG. 4 is a block diagram of the mobile terminal according to some embodiments of the present disclosure, wherein the mobile terminal may include:

a recording module 401 configured to in response to an unlocking event, record a trigger time of the unlocking event;

a first sending module 402 configured to in response to the unlocking event, send a request for unlocking verification information to a cloud server, wherein the request for the unlocking verification information is used to request the cloud server to return a verification code of a smart door lock, and the unlocking verification information includes a private key seed of the smart door lock and the trigger time of the unlocking event; and a first receiving module 403 configured to receive the verification code of the smart door lock for opening the smart door lock generated by the cloud server based on the private key seed and the trigger time.

In some embodiments, the unlocking event may include at least one of a click confirmation operation, a sliding operation, or a login operation by inputting a password or authentication information.

Figure 5:
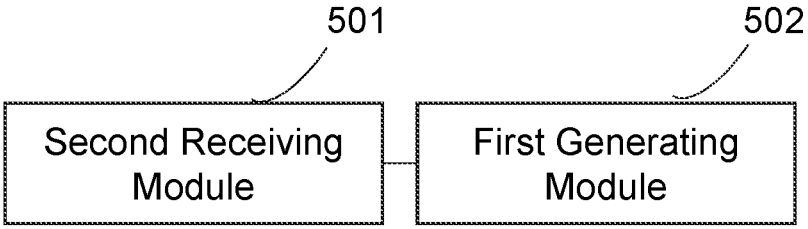
FIG. 5 is a block diagram of a cloud server according to some embodiments of the present disclosure.

Corresponding to the above embodiments, the present disclosure also provides a cloud server with reference to FIG. 5. FIG. 5 is a block diagram of a cloud server according to some embodiments of the present disclosure, wherein the cloud server may include:

a second receiving module 501 configured to receipt of a request for unlocking verification information from a mobile terminal, the unlocking verification information including a private key seed of a smart door lock and the trigger time recorded by the mobile terminal in response to an unlocking event; and a first generating module 502 configured to generate a verification code of a smart door lock after a matching verification of the private key seed is successful and returning the verification code to the mobile terminal for opening the smart door lock.

In some embodiments, the cloud server may be provided with a preset private key seed database configured to store a private key seed of each smart door lock; and the cloud server may further include:

a verification module configured to compare the private key seed and the private key seed of each smart door lock stored in the preset private key seed database, and determine that the matching verification of the private key seed is successful if a comparison is successful.

In some embodiments, the first generating module 502 may include:

a generating sub-module configured to generate a verification code using a preset first verification code generation algorithm based on the private key seed and the trigger time within a time period which the trigger time belongs to; and a returning sub-module configured to return the verification code to the mobile terminal for opening the smart door.

In some embodiments, the cloud server may further include:

a second generating module configured to generate a password generation instruction, wherein the password generation instruction is used to make the verification code of the smart door lock take effect in the smart door lock; and a returning module configured to return the password generation instruction to the mobile terminal.

In some embodiments, the second generating module may be configured to:

generate the password generation instruction based on a start code, a command code, a type code, a validity period code, a password, a password ID, a time factor, and a private key seed.

Figure 6:
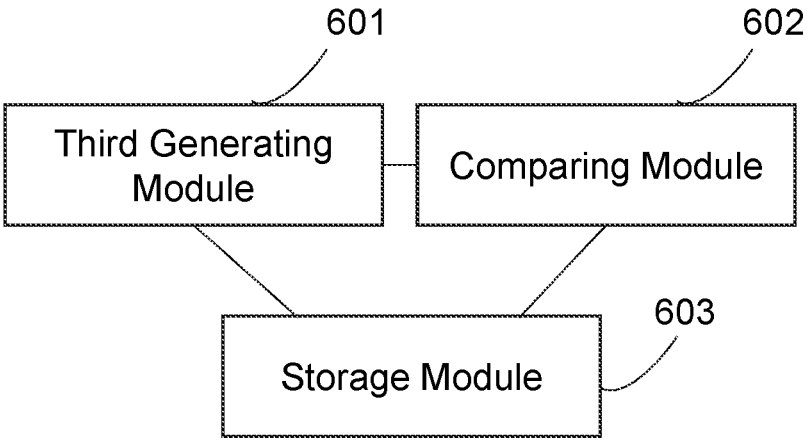
FIG. 6 is a block diagram of a smart door lock according to some embodiments of the present disclosure.

Corresponding to the above embodiments, the present disclosure also provides a smart door lock with reference to FIG. 6. FIG. 6 is a block diagram of the smart door lock according to some embodiments of the present disclosure, wherein the smart door lock may include:

a third generating module 601 configured to generate a verification code for a current time period using a preset first verification code generation algorithm based on a private key seed of the smart door lock;

a comparing module 602 configured to in response to receipt of an inputted verification code, compare the inputted verification code with the verification code for the current time period, and opening the smart door lock if the inputted verification code is same as the verification code for the current time period; and a storage module 603 configured to storage one or more verification codes and corresponding information of the one or more verification codes. In some embodiments, the one or more verification codes may be generated by the third generating module 601. The corresponding information of the one or more verification codes may include a usage record of a verification code, a usage threshold count, or the like, or any combination thereof. The usage record of a verification code may include a usage count of a verification code, a usage time of a verification code, a user ID for requesting a verification code, status information indicating whether a verification code has been used, a result of a verification operation of a verification code, or the like, or any combination thereof. For example, if a verification code has been used to unlock the smart door lock, a record corresponding to the verification code may be updated. The record may include a usage count of the verification code, an unlocking event time, a verification result, or the like.

In some embodiments, the storage module 603 may store one or more verification codes valid for a time period. If any of the one or more verification codes has been used to unlock the smart door lock, then it may be deleted from the storage module 603.

In some embodiments, based on the data stored in the storage module 603, a user may use a mobile terminal to retrieval one or more unlocking records of a smart door lock. For example, the mobile terminal may be operably connected to the smart door lock through Bluetooth. In response to a retrieval request form the mobile terminal, the smart door lock may retrieve and transmit one or more records (e.g., unlocking records, abnormal event records) of the smart door lock to the mobile terminal. Exemplary unlocking records may include: an unlocking mode (e.g., in response to a verification codec input through the keypad, in response to a verification code received from a mobile terminal through Bluetooth, in response to a verification code received from a mobile terminal through NFC), an unlocking time, a user ID under which a verification code is requested. The abnormal event records may correspond to a plurality type of events, such as password error, a usage count of password exceeding a threshold, generating a warning notification, or the like, or any combination thereof. Exemplary abnormal event records may include an event type (e.g., password error), a time of the event (e.g., a start time of an event), or the like, or a combination thereof.

In some embodiments, data stored in the storage module 603 may be uploaded to the cloud server through a mobile terminal operably connected to the smart door lock. The connection between the mobile terminal and the smart door lock may be established based on a wired connection or a wireless connection as described in FIG. 7.

In some embodiments, the smart door lock may further include:

an effective module configured to make the verification code for the current time period take effect in response to receipt of a password generation instruction.

Figure 7:
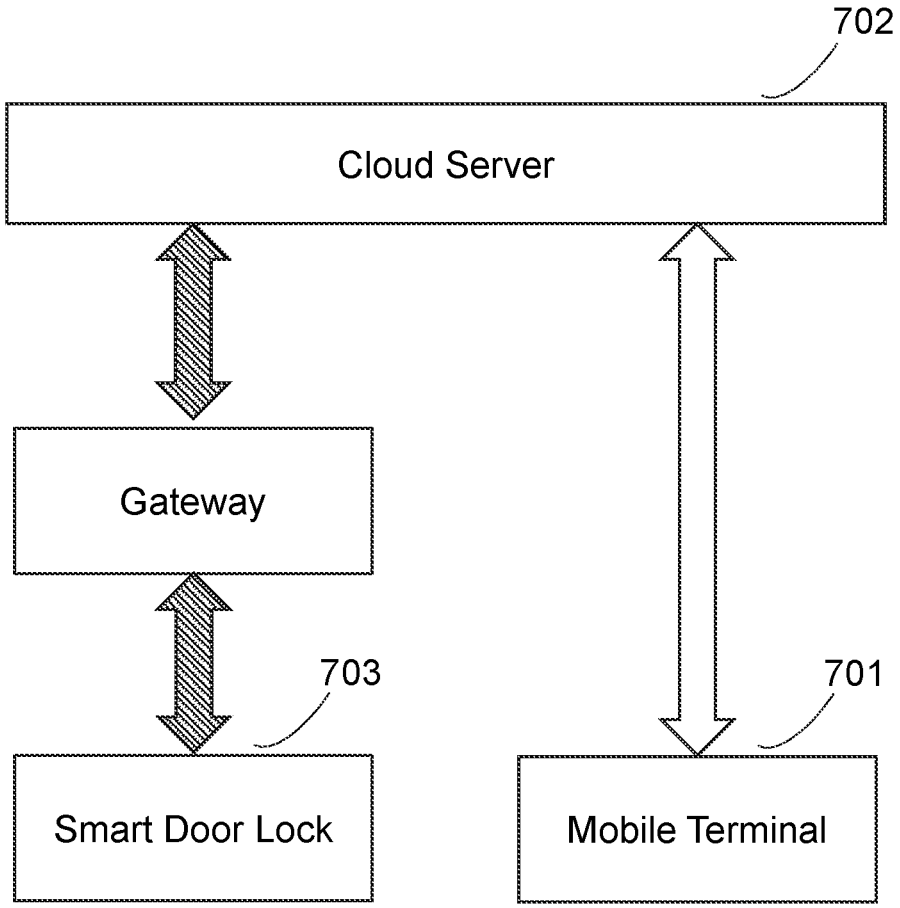
FIG. 7 is a block diagram of a smart door lock system according to some embodiments of the present disclosure.

Corresponding to the above embodiments, the present disclosure also provides a smart door lock system with reference to FIG. 7. FIG. 7 is a block diagram of the smart door lock system according to some embodiments of the present disclosure, wherein the smart door lock system may include: a mobile terminal 701, a cloud server 702, and a smart door lock 703. Shaded arrows between the smart door lock, the gateway, and the cloud server may indicate that no wireless communication is required between the smart door lock, the gateway, and the cloud server. Therefore, a gateway module may not need to be installed, and the smart door lock may not need to be installed with a communication module.

The mobile terminal 701 may be configured to record a trigger time of the unlocking event in response to an unlocking event, send a request for unlocking verification information to a cloud server, wherein the request for the unlocking verification information is used to request the cloud server to return a verification code of a smart door lock, and the unlocking verification information includes a private key seed of the smart door lock and the trigger time;

The cloud server 702 may be configured to generate the verification code of the smart door lock after a matching verification of the private key seed is successful and return the verification code to the mobile terminal for opening the smart door lock;

The smart door lock 703 may be configured to generate a verification code for a current time period using a preset first verification code generation algorithm based on a private key seed of the smart door lock; in response to receipt of an inputted verification code, compare the inputted verification code with the verification code for the current time period, the smart door lock being unlocked if the inputted verification code is the same as the verification code for the current time period.

In some embodiments, the verification code may be provided to the smart door lock 703 through a keypad (not shown). The keypad may include one or more keys, a notification device, a communication device, or the like, or a combination thereof. The keypad may be configured to receive a user input through the one or more keys. The one or more keys may include one or more physical keys, one or more virtual keys, or a combination of physical keys and virtual keys. For example, the one or more keys may include 10 virtual keys for indicating the Hindu-Arabic system 0-9 and a physical key for receiving a confirmation instruction from the user.

The notification device may include an audio device, a light-emitting device, a display device, or the like, or any combination thereof. The notification device may be configured to generate and/or convey a notification in response to a corresponding triggering signal. The notification may include a text, a sound, a light, or the like, or any combination thereof. For example, the notification may include emitting a red light and generating a beeping sound at the same time. As another example, the notification may include emitting a red light and a blue light alternately at a specific frequency. As a further example, the notification may include displaying a warning message on the display device. A mapping relationship between the notification and the corresponding triggering signal may be determined based on a default setting of a smart door lock system or be set or changed based on a user instruction. For example, a default setting of a triggering signal for indicating successfully unlocking the smart door lock may include emitting a white light and a default setting of a triggering signal for indicating successfully locking the smart door lock may include emitting a green light. It can be changed, based on a user instruction, to include emitting a red light when successfully unlocking the smart door lock and emitting a white light when successfully locking the smart door lock.

In some embodiments, in response to determining that the inputted verification code is the same as the verification code for the current time period (or the smart door lock is changed from a locked state to an unlocked state), a first triggering signal may be generated. In response to the first triggering signal, the notification device may generate a first notification (e.g., a sound "Do Re Mi", emitting a white light). In some embodiments, in response to determining that the inputted verification code is not the same as the verification code for the current time period, a second triggering signal may be generated. In response to the second triggering signal, the notification device may generate a second notification (e.g., a sound "Do (with Fermata)", emitting a red light). In some embodiments, in response to determining that the number (or count) of attempts is more than a threshold (e.g., 1 time, 3 time per day, 5 times per hours, 3 times per hours, 3 times within 10 minutes), a third triggering signal may be generated. In response to the third triggering signal, the notification device may generate a third notification (e.g., a specific sound, a specific light, a text message, or a combination thereof).

In some embodiments, the keypad may include or operably connected to a communication device. Data transmission and reception (e.g., transmitting the inputted verification code from the keypad to the smart door lock) between the keypad and the smart door lock may be established based on the communication device and one or more components of the smart door lock. The data transmission and reception may be established based on a wired connection, a wireless connection, or a combination of both that enables data transmission and reception. The wired connection may include a metal cable, an optical cable, a hybrid cable, or the like, or any combination thereof. The wireless connection may include a Local Area Network (LAN), a Wide Area Network (WAN), a Bluetooth, a ZigBee, a Near Field Communication (NFC), or the like, or any combination thereof.

In some embodiments, the keypad may be configured as a portion of the smart door lock and the inputted verification code of the smart door lock received by the keypad may be transmitted to the smart door lock through a cable, e.g., a metal cable.

In some embodiments, the keypad is not physically connected to the smart door lock via, e.g., a cable, and data transmission and reception between the keypad and the smart door lock may be established based on a wireless connection, e.g., Bluetooth. For example, the keypad may be a portable device including a Bluetooth communication module. As another example, the keypad may be disposed on a wall of a confined space the access to which may be controlled by the smart door lock.

In some embodiments, a connection for data transmission and reception may be established when a distance between the keypad and the smart door lock is lower than a distance threshold. The distance threshold may be 0.5 m, 1.0 m, 1.5 m, 2.0 m, 3.0 m, 4.0 m, 10.0 m, 20.0 m, or the like. The distance threshold may be determined based on one or more parameters (e.g., power, data transmission speed, the mode of connection/communication of the communication device via which the keypad and the smart door lock is operably connected and/or communicate) of the communication device of the keypad and/or a communication portion of the smart door lock.

In some embodiments, an unlocking waiting time may include a first waiting time and a second waiting time. The first waiting time may be a time period from a time point when a verification code is received from an input device (e.g., a keypad) to a time point when the verification code is received by the smart door lock. The second waiting time may include a time period from the time point when the verification code is received by the smart door lock to a time point when a motor driving a bolt to move to an unlocking location. The time of the motor driving the bolt to move may make up a major proportion (e.g., above 60%, above 70%, above 80%, above 90%) of the second time period. In some embodiments, the unlocking waiting time may be less than 2 seconds and include the first waiting time (depending on the distance between the keypad and the smart door lock) no longer than 1 second and the second waiting time (depending on the motor) no longer than 1 second.

It should be noted that the above descriptions of the smart door lock are intended to be illustrative, and not to limit the scope of the present disclosure. The above descriptions of the smart lock system may be applied in a variety of scenarios including, e.g., a vehicle, a door, a building, an intelligent home, a box, or the like, or a combination thereof.

In some embodiments, the vehicle may include a bicycle, a motor vehicle, a railed vehicle, a watercraft, an amphibious vehicle, an aircraft, or the like. For example, the vehicle may include a shared car for on demand service and the smart door lock may be installed on, or otherwise associated with, the shared car for controlling access to the shared car. Based on the smart door lock provided in the present disclosure, even if the shared car is parked in a region wherein the smart door lock can not communicate with a cloud server, the smart door lock may be unlocked to make the shared car accessible based on an offline verification code (e.g., a verification code pre-stored in the smart door lock).

In some embodiments, the door may include any type (e.g., hinged, sliding, or revolving) of barrier at an entrance to a space (e.g., a building, a room, a vehicle, a house, a cupboard, a cabinet, or the like). For example, the door may include a door of a house and the smart door lock may be associated with the door for controlling access to the house by a visitor (e.g., a service provider such as a baby-sitter, a plumber, a messenger, or the like). The visitor may enter into the house after unlocking the smart door lock of the door based on the offline verification code described in the present disclosure.

In some embodiments, the box may include a delivery box, a safety box, a lock box, a gun safe, or the like. For example, the lock box may be configured to store one or more keys (e.g., a spare key to a house which can give a family member or friend access to the house in an emergency, a key for an item stored outdoor, such as a lawn mower, a bike, etc. The smart door lock may be configured to control access to the lock box for obtaining the one or more keys. As another example, the delivery box may be configured to receive and keep packages and deliveries. When delivering a package to a delivery box installed with a smart door lock, a courier may use a mobile terminal to send a request for unlocking the delivery box including verification information to a cloud server. The request may be generated by the mobile terminal based on delivery information of the package to be delivered (e.g., delivery address, delivery box ID, order number, tracking number, etc.). The cloud server may generate a verification code of the smart door lock and return the verification code of the smart door lock to the mobile terminal for unlocking the smart door lock. The verification code of the smart door lock may be transmitted from the mobile terminal to the smart door lock through a wireless connection (e.g., Bluetooth) between the mobile terminal and the smart door lock or be inputted by the courier through a keypad. More details regarding the wireless connection and the keypad may be found elsewhere in the present disclosure.

Figure 8:
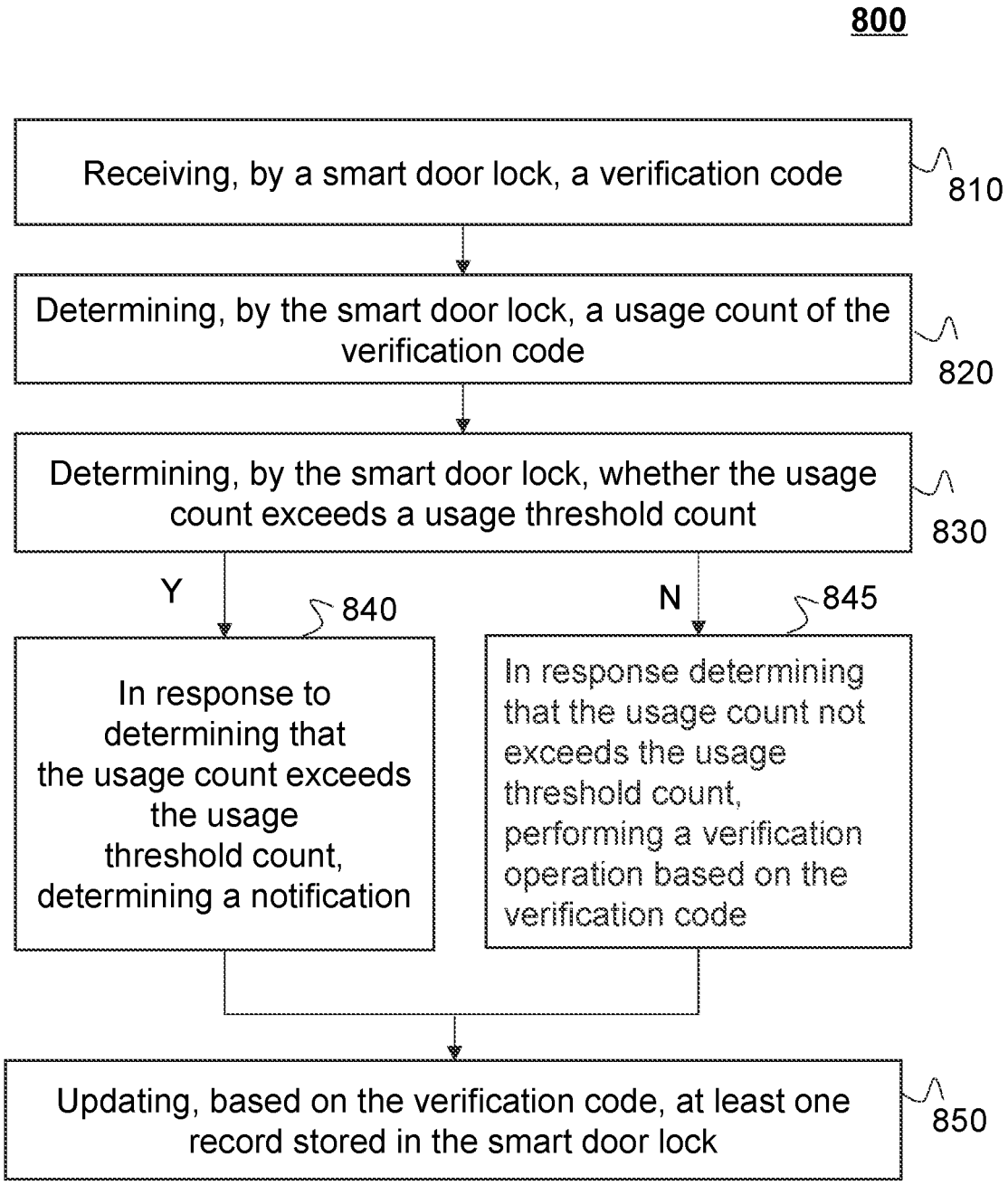
FIG. 8 is a flowchart illustrating a process for offline verification code management based on a smart door lock system according to some embodiments of the present disclosure.

FIG. 8 is a flowchart illustrating a process for offline verification code management based on a smart door lock system according to some embodiments of the present disclosure. In some embodiments, the process 800 may be implemented in the smart door lock system illustrated in FIG. 7. The operations of the illustrated process 800 presented below are intended to be illustrative. In some embodiments, the process 800 may be accomplished with one or more additional operations not described, and/or without one or more of the operations discussed. Additionally, the order in which the operations of the process 800 as illustrated in FIG. 8 and described below is not intended to be limiting.

In 810, the smart door lock may receive a verification code from a user. In some embodiments, the verification code may be received by the smart door lock through a keypad as illustrated in FIG. 7. In some embodiments, the verification code may be received by the smart door lock through a wireless connection (e.g., Bluetooth) between a terminal (e.g., a mobile phone) and the smart door lock.

In 820, the smart door lock may determine a usage count of the verification code. The usage count may include an absolute usage count or a relative usage count. As used herein, an absolute usage count is a usage count of the verification code (the number of times the verification code has been used) counted since the smart door lock was manufactured. As used herein, a relative usage count is a usage count of the verification code (the number of times the verification code has been used) counted within a time period (e.g., every day, every week, every month). In some embodiments, the time period may be set based on the factory setting of the smart door lock. In some embodiments, the time period may be set based on a user instruction. For example, the user may set a counting period of the usage count is 5 days and begins from Sep. 7, 2021.

In 830, the smart door lock may determine whether the usage count exceeds a usage count threshold. The usage count threshold may be any positive integer, e.g., 1, 2, 5, 7, 10, 14, 20, 30, or the like. The usage count threshold may be set by a user or determined based on a process. In some embodiments, the process may include determining the usage count threshold by analyzing data of the smart door lock (e.g., historical usage data of the smart door lock), data of one or more users of the smart door lock (e.g., calendar data of the one or more users of the smart door lock), or the like, or any combination thereof.

The usage count threshold may include a general count threshold or a combination count threshold. As used herein, the general count threshold indicates that a single count threshold is employed for all situations. As used herein, a combination count threshold indicates that more than one count threshold are employed for satisfying a plurality of situations. For example, for a smart door lock installed on a door of a factory, a usage count threshold may include 2, in which a first count threshold may be 10 for workdays and a second count threshold may be 2 for weekends.

In some embodiments, the verification code may be a one-time verification code. That is to say, the verification code may authenticate a user fora single login or transaction. For example, the one-time verification code may be implemented based on an absolute usage count of 1 in 820 and a general count threshold of 1 in 830. In some embodiments, the one-time verification code may be implemented without the need to record the usage count of the verification code; once a verification code is received by a smart door lock, corresponding information relating to the verification (e.g., information for authenticating the verification code, such as the reference verification code as illustrated in S203 of FIG. 2) may be deleted or disabled from a storage module 603 of the smart door lock.

In 840, in response to determining that the usage count exceeds the usage count threshold, a notification is determined. The notification may include a text, a sound, a light, or the like, or any combination thereof. More details regarding the notification may be found elsewhere in the present disclosure. See, e.g., the description in FIG. 7.

In 845, in response to determining that the usage count does not exceed the usage threshold count, the smart door lock may perform a verification operation based on the verification code. The verification operation may fail or succeed, which may lead to keep the smart door lock locked or unlock the smart door lock. Base on a result of the verification operation, a notification as illustrated in FIG. 7 may be generated by the smart door lock system.

In 850, the smart door lock may update, based on the verification code, at least one record stored in the smart door lock. The at least one record may include time information (e.g., a time point of receiving the verification code from the user in 810), a usage count of the verification code, a comparing result of the usage count with a usage count threshold, a verification result of the verification code in 845, or the like, or any combination thereof.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For example, 820, 830, and 840 may be skipped or omitted in some embodiments. That means the verification operation in 850 may be directly performed following the receiving of the verification code in 810.

The serial numbers of the embodiments are for the purpose of description only and do not represent the advantages and disadvantages of the embodiments.

In the embodiments of the present disclosure, the descriptions of each embodiment have its own emphasis, and parts not detailed in one certain embodiment may be referred to in the related descriptions of other embodiments.

In several embodiments provided by the present disclosure, it should be understood that the disclosed technical contents may be implemented in other manners. The device embodiments described above are only illustrative. For example, the division of the units may be a logical function division. In practice, there may be another division mode, such as multiple units or components can be combined or integrated into another system, or some features can be ignored or not executed. Another point is that the coupling or direct coupling or communication connection shown or discussed may be indirect coupling or communication connection through some interfaces, units or modules, and may be electrical or other forms.

The units described as separate components may or may not be physically separated, and the components shown as units may or may not be physical units, i.e., it may be located in one place, or may be distributed over a plurality of units. Some or all of the units may be selected according to actual needs to achieve the purpose of the embodiments of the present disclosure.

In addition, the functional units in the various embodiment of the present disclosure may be integrated into one processing unit, may be physically present separately for each unit, or may be integrated into one unit by two or more units. The integrated unit can be implemented in the form of hardware or software functional unit.

The above is only the preferred implementation of the present disclosure. It should be pointed out that for those skilled in the art, without departing from the principles of this application, a number of improvements and modifications can also be made, and these improvements and modification should also be considered as the scope of protection of the present disclosure.

We claim:

1. A method for offline verification code generation based on a smart door lock system, comprising:

receiving, by a smart door lock, a password generation instruction, wherein the password generation instruction is generated and returned by a cloud server to a mobile terminal of a user, the password generation instruction includes a verification code and a check code, the check code is used to verify legitimacy and integrity of the password generation instruction, and the verification code is associated with a trigger time corresponding to a request from the user;

generating, by the smart door lock, one or more reference verification codes using a preset first verification code generation algorithm based on a private key seed of the smart door lock, wherein each of the one or more reference verification codes is associated with time information;

generating, by the smart door lock, the verification code using the password generation instruction;

comparing, by the smart door lock, the verification code generated using the password generation instruction with the one or more reference verification codes; and performing, by the smart door lock, a first operation in response to determining that the verification code generated using the password generation instruction is the same as a certain reference verification code of the one or more reference verification codes.

2. The method of claim 1, further including:

a second operation in response to determining that the verification code generated using the password generation instruction is different from each of the one or more reference verification codes, wherein the performing the second operation includes keeping the smart door lock being locked.

3. The method of claim 1, wherein the performing the first operation includes:

unlocking the smart door lock.

4. The method of claim 1, wherein the performing the first operation includes:

deleting data stored in the smart door lock, the data including a password or a usage record of the verification code.

5. The method of claim 1, further including:

activating a password of the smart door lock based on the password generation instruction.

6. The method of claim 1 further including:

determining a usage count of the verification code;

obtaining a usage count threshold;

comparing the usage count threshold with the usage count of the verification code; and in response to determining that the usage count of the verification code exceeds the usage count threshold, determining a notification for indicating the comparing result.

7. The method of claim 1, wherein the verification code includes a one-time verification code.

8. The method of claim 1, wherein the request from the user is sent by a terminal, and the trigger time is recorded by the terminal according to a timing mechanism of the terminal.

9. The method of claim 1, wherein the trigger time is recorded by the cloud server based on a time point when the cloud server received the request from the user.

10. The method of claim 1, wherein the password generation instruction is inputted through a keypad.

11. The method of claim 10, wherein the password generation instruction is transmitted from the keypad to the smart door lock through Bluetooth.

12. The method of claim 1, wherein the one or more reference verification codes include at least a first set of verification codes and a second set of verification codes, verification codes included in the first set of verification codes being valid in a first time period and verification codes included in the second set of verification codes being valid in a second time period, the method further including:

in response to determining that the trigger time is in the first time period and the certain reference verification code is determined not in the first set, determining the certain reference verification code in the second set.

13. A smart door lock, comprising:

at least one storage device including a set of instructions;

at least one processor in communication with the at least one storage device, wherein when executing the set of instructions, the at least one processor is configured to cause the smart door lock to:

receive a password generation instruction, wherein the password generation instruction is generated and returned by a cloud server to a mobile terminal, the password generation instruction includes a verification code and a check code, the check code is used to verify legitimacy and integrity of the password generation instruction, and the verification code is associated with a trigger time corresponding to a request from a user;

generate one or more reference verification codes, wherein each of the one or more reference verification codes is associated with time information;

generate the verification code using the password generation instruction;

compare the verification code generated using the password generation instruction with the one or more reference verification codes; and unlock the smart door lock in response to determining that the verification code generated using the password generation instruction is the same as a certain reference verification code of the one or more reference verification codes.

14. The smart door lock of claim 13, wherein the at least one processor is further configured to cause the smart door lock to:

delete data stored in the smart door lock, the data including a password or a usage record of the verification code.

15. The smart door lock of claim 13, wherein the at least one processor is further configured to cause the smart door lock to:

activate a password of the smart door lock based on the password generation instruction.

16. The smart door lock of claim 13, wherein the at least one processor is further configured to cause the smart door lock to:

determine a usage count of the verification code;

obtain a usage count threshold;

compare the usage count threshold with the usage count of the verification code; and in response to determining that the usage count of the verification code exceeds the usage count threshold, determine a notification for indicating the comparing result.

17. The smart door lock of claim 13, wherein the verification code includes a one-time verification code.

18. The smart door lock of claim 13, wherein the request from the user is sent by a terminal, and the trigger time is recorded by the terminal according to a timing mechanism of the terminal.

19. The smart door lock of claim 13, wherein the trigger time is recorded by the cloud server based on a time point when the cloud server received the request from the user.

20. The smart door lock of claim 13, wherein the password generation instruction is received by a keypad and transmitted from the keypad to the smart door lock.

21. A system, comprising:

at least one storage device including a set of instructions; and at least one processor in communication with the at least one storage device, wherein when executing the set of instructions, the at least one processor is configured to cause the system to:

receive a request for unlocking a smart door lock from a user; and generate a password generation instruction, wherein the password generation instruction includes a verification code and a check code, the check code is used to verify legitimacy and integrity of the password generation instruction, the verification code is associated with a trigger time corresponding to the request from the user, wherein the verification code generated by the smart door lock using the password generation instruction is configured to be compared with one or more reference verification codes stored in the smart door lock, the smart door lock being unlocked if the verification code is the same as a certain reference verification code of the one or more reference verification codes.

* * * * *